United States Patent [19]

Narozny

[11] 4,006,957

[45] Feb. 8, 1977

[54] CONNECTOR

[75] Inventor: Ronald S. Narozny, Panorama City, Calif.

[73] Assignee: Thomas & Betts Corporation, Elizabeth, N.J.

[22] Filed: Feb. 23, 1976

[21] Appl. No.: 660,537

Related U.S. Application Data

[63] Continuation of Ser. No. 509,236, Sept. 25, 1974, abandoned.

[52] U.S. Cl. ..... 339/103 M; 339/277 R

[51] Int. Cl.² ..... H01R 13/58

[58] Field of Search ..... 339/103 M, 103 R, 75 M, 339/75 R, 76, 91 R, 97 R, 98, 99 R, 277 R

[56] References Cited

UNITED STATES PATENTS

| | | | |
|---|---|---|---|
| 3,434,093 | 3/1969 | Wedekind | 339/99 R X |
| 3,702,982 | 11/1972 | Kelly et al. | 339/99 R |
| 3,816,818 | 6/1974 | Meier | 339/99 R |

*Primary Examiner*—Roy Lake
*Assistant Examiner*—DeWalden W. Jones
*Attorney, Agent, or Firm*—David Teschner; Jesse Woldman

[57] ABSTRACT

An improved connector for coupling the individual conductors of a multi-conductor flat cable to a termination point which may be a socket for receiving the pins of a further connector or the like comprising a base member having a plurality of apertures extending from a first to a second surface, the number of apertures being equal to the number of individual conductors found in the flat cable. Placed in each of these apertures is a contact having a first end which can pierce through the insulation of the multi-conductor cable and make contact with an individual conductor placed in association therewith and which end is placed adjacent the first surface of the base member of the connector. The contact terminates in a contact tail portion which extends towards the second surface of the base member in a socket for receipt therein and contact with the pin of a further connector, or the like. By providing a generally rectangular aperture within the base member to receive the electrical contacts and by making the aperture larger at the first surface a shelf is provided to prevent the contact from moving downwardly through the base member and out of the aperture adjacent the second surface of the base member. Placed atop and coupled to the first surface of the base member is a keeper means which has a plurality of apertures of a different configuration than those of the apertures in the base member and when so coupled to the base member are aligned with the apertures of the base member so as to contain the contacts within the base member preventing their withdrawal in the direction of the first surface and which provides support for the contacts at their insulation piercing ends. A cover member, provided with selectively operable latch members, is attached to the base member such that a channel is provided to permit the passage of flat cable therethrough without contacting the contact means and which can be moved to a second position to cause engagement between the individual conductors of a flat cable and their associated contacts. Finally, with an additional set of latch members, a strain relief means is provided whereby the flat cable can be, to a degree, isolated from the shocks provided by attempted movement of the cable along its longitudinal direction and which causes a clamping of the flat cable between such strain relief member and the outer surface of the cover.

7 Claims, 10 Drawing Figures

66
22
82
70
50
44
60
58
20

74
70
72
66
66
64
44
22
50

50
64
34
32
38
44
39
60
58
22
82
20
62

CONNECTOR

This is a continuation of application Ser. No. 509,236 filed Sept. 25, 1974, now abandoned.

CROSS REFERENCE TO RELATED APPLICATION

1. Electrical Contact by Ronald S. Narozny Ser. No. 499,588 Filed Aug. 22, 1974 Assigned to the assignee of the instant invention.

2. Selectively Positionable Latch Means by Ronald S. Narozny Ser. No. 500,177 Filed Aug. 23, 1974, now abandoned Assigned to the assignee of the instant invention.

BACKGROUND OF THE INVENTION

1. Field of the Invention

The invention is directed to the field of terminating the individual conductors of a multi-conductor flat cable to further terminal points which may be, for example, for receipt therein of the pins of further electrical connectors or of printed circuit boards or the like. Such connectors find their principle employment in use as a transition between a printed circuit board and a flat cable.

2. Description of the Prior Art

According to prior art techniques, there are available connectors for conducting individual conductors of a flat cable to further terminal points which may be, in fact, a socket for receipt therein of the pins of a further connector, a printed circuit board, or the like. The contacts in such a prior art connector are placed into a base member having formed apertures therein such as to prevent the unwanted movement of the contacts in a second direction, that is, towards the second, or bottom, surface of the base member. However, the contacts are generally free to move in a first direction with respect to the base member's first, or top surface. The only restraint is the frictional engagement between the contact and the aperture walls. The contacts are only fixed in place and prevented from moving in said first direction at such time as a flat cable is placed thereover and the cover means is employed to force the individual conductors of the flat cable into the insulation piercing upper portions of the contacts thus making a union between the conductors and the contacts, and, further, when the cover if fully closed, causing the engagement of a latching mechanism which assures the integrity of the connector and prevents unwanted separation of the component parts. The attempted assembly of the cover means of the connector to the base member and the individual conductors of a multiconductor cable with the contacts of the base member of the connector provides some difficulty in that any motion, other than direct downward motion, can cause a bending or displacement of the contacts in such a manner that improper connection, or no connection at all, will be made between the contacts and the conductors of the flat cable. In order to eliminate the misalignment problems a technique employed by one of the connectors found in the prior art is to include a slot for receipt of the end of a flat cable within the upper portion of the connector with a plurality of apertures arranged to be in alignment with individual contacts found in the base portion. In this manner, one has only to align the contacts in the base portion with the apertures in the upper portion and force the two portions together to permit the engagement between the contacts and the flat cable. Again, however, any motion of any component in a direction other than downward, or, should the cable be cocked within the upper portion, an improper connection or destruction of the contacts or other portions of the connector is quite possible. Finally, the only way to assure interconnection of the component portions of the connector is in final assembly when the external latches of the connector are assembled.

SUMMARY OF THE INVENTION

The present invention overcomes the difficulties noted above with respect to the prior art devices by providing a connector which is simple to use and which can make the assembly of the individual conductors of a flat cable to a terminal point simpler than is possible with prior art devices. This is accomplished by providing a base member with properly shaped apertures such that the electrical contacts placed therein, and running from a first surface to a second surface thereof, cannot be removed via such second surface. A keeper means, having a plurality of apertures therein, of a configuration different than the configurations of the apertures extending through the base member, is then coupled to the base member along its first surface such that the contacts are permitted to extend through the apertures within the keeper means and are retained within the base member and are supported by means of said apertures and the material of the keeper means itself. Coupled externally to the connector is a cover member coupled by means of a selectively operable latch means which in a first position provides a passage between a bottom surface of the cover member and the upper surface of the contacts such that a flat cable can be introduced therebetween and the connector moved with respect to the cable without interference between the contacts and the cable. The contacts are of the insulation piercing type which have bifurcated upper portions for receipt between the arms thereof of the individual conductors of the flat cable and provides a tail at the opposite end and which can be made to engage the pins of a further connector, or the like. Finally, a strain relief means is provided to clamp the flat cable between the upper surface of the cover member and the strain relief means after the same have been terminated within the connector. It is therefore an object of this invention to provide an improved form of connector for flat cable.

It is yet another object of this invention to provide an improved form of connector for flat cable employing insulation and oxide piercing contacts which are retained within the body portion of the connector.

It is yet another object of this invention to provide an improved form of connector for flat cable wherein the insulation and oxide piercing electrical contacts of such connector are retained in the base member by means of a keeper means having apertures extending therethrough of a configuration different than the configuration of the apertures within the base member initially receiving the electrical contacts.

Other objects and features of the invention will be pointed out in the following description and claims and illustrated in the accompanying drawings, which disclose, by way of example, the principles of the invention, and the best mode which has been contemplated for carrying it out.

BRIEF DESCRIPTION OF THE DRAWINGS

In the drawings in which similar elements are given similar reference characters.

DESCRIPTION OF THE PREFERRED EMBODIMENTS

Figure 1:
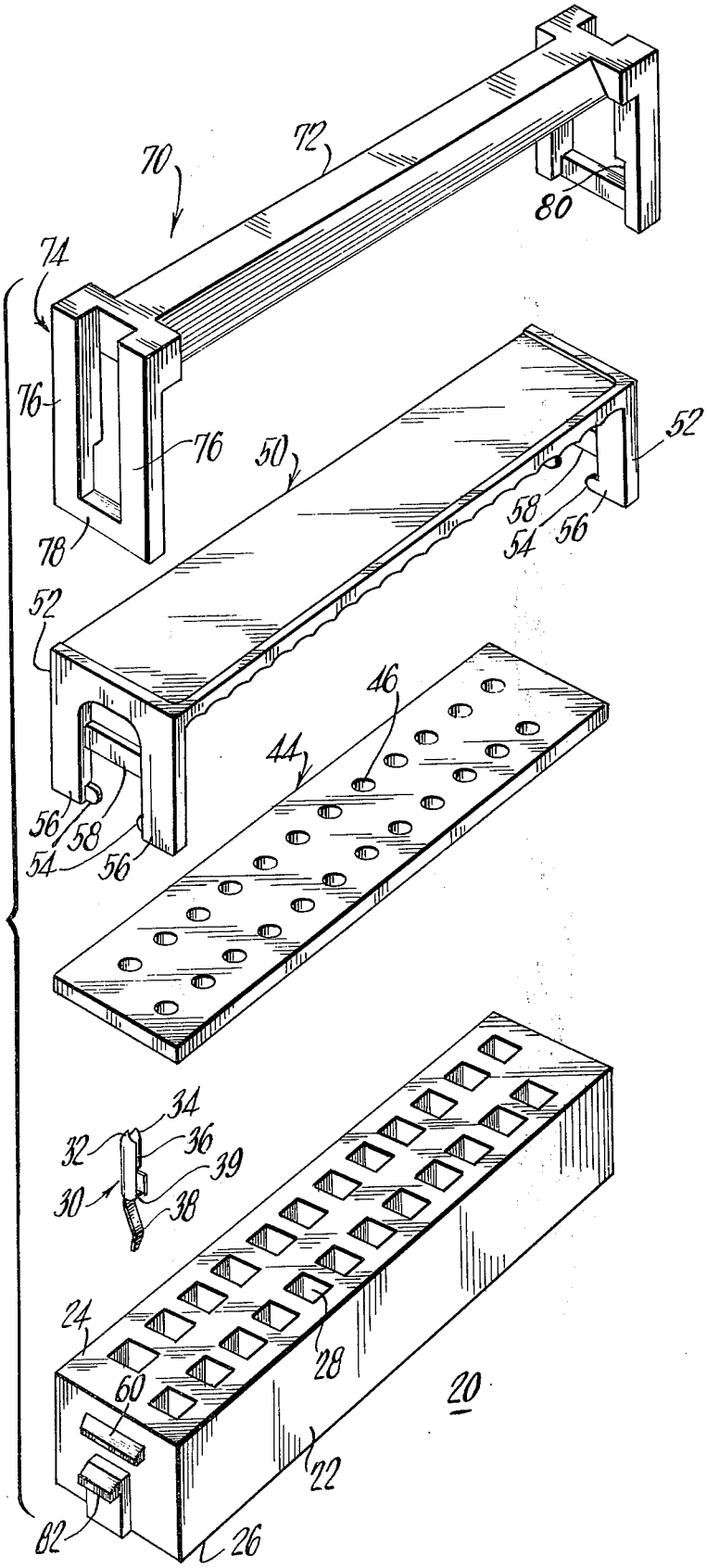
FIG. 1 is a front perspective view, in exploded form, of a connector constructed in accordance with the concepts of the invention.
Figure 2:
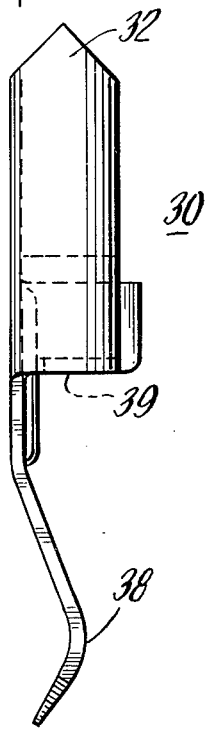
FIG. 2 is a side elevational view of a contact used with the connector of FIG. 1.

Turning now to FIG. 1 there is shown a connector 20 constructed in accordance with the concepts of the invention. Connector 20 has a base member 22 having a first surface 24 and a second surface 26 (not visible in FIG. 1) with a plurality of apertures 28 extending therebetween. Placed within each one of the apertures 28 is a contact 30 whose upper portion has a pair of extending arms 32, 34 defining therebetween an insulation piercing slot 36 for receipt of the individual conductor of a multi-conductor flat cable inserted within the connector 20. As is better described in the first application noted above titled "Connector" the sharpened points of the arms 32, 34 will pierce through the insulation of the conductor and the arms 32 and 34 will cause the stretching away of the insulation until the individual conductor is brought within the slot 36 and a good contact made between the arms 32 and 34 with such conductor. At the opposite end of the contact 30 is a contact tail 38, which, as will be explained below, is arranged to make contact with the extending pin of a further connector or the like.

Figure 4:
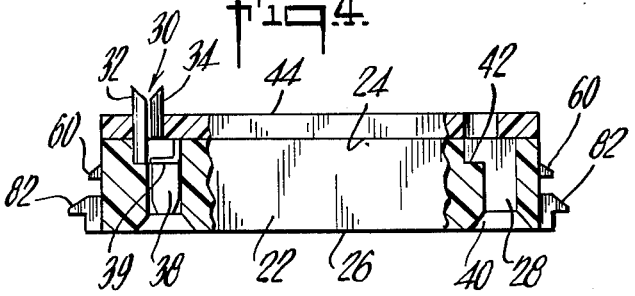
FIG. 4 is a front elevational view, partly in section, showing the partial assembly of the connector of FIG. 1.
Figure 5:
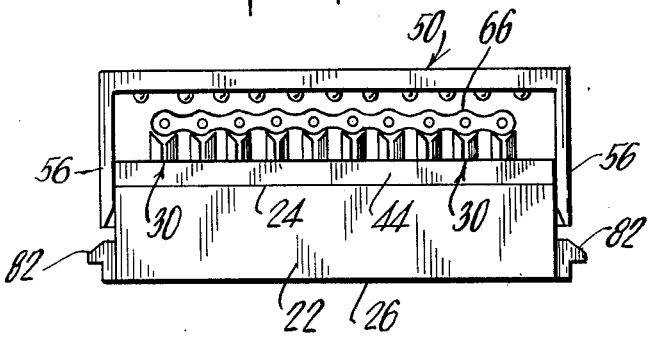
FIG. 5 is a front plan view showing a further step in the assembly of the component portions of the connector of FIG. 1.
Figure 3:
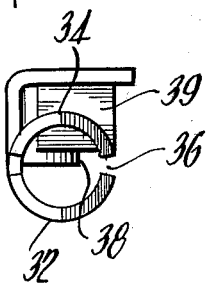
FIG. 3 is a top plan view of the contact of FIG. 2.

As can be best appreciated in FIG. 4, aperture 28 has a slightly enlarged portion tapered as at 40 to permit the pins of a further connector to be brought into contact with the contact tail 38 positioned within such aperture 28. At the upper end of the aperture 28, adjacent the first surface 24 of the base member 22, the aperture is also enlarged as at 42. The contact 30 is positioned within the aperture 28 such that its upper contact portions 32 and 34 are within the aperture enlargement 42 and the contact tail portion 38 extends within the aperture 28 from a position just at the beginning of the flaired portion 40 to a tab 39 at the beginning of flaired portion 40. The tab 39 serves to limit the insertion of a pin into the aperture 28.

A keeper means 44, having a plurality of apertures 46 therein, is positioned over top of the base member 22 such that it overlies the upper surface 24 of such base member 22. It may be affixed to the upper surface of the base member 22 by means of external coupling devices or affixed by means of sonic welding, adhesives, or any other similar means. It should be noted that apertures 46 are circular in configuration, whereas the apertures 28 of the base member 22 are rectangular. Further, it should be noted that the diameter of the apertures 46 are somewhat less than the diameter of the apertures 28 enlargements 42. Finally, the alignment of aperture 46 is such that one edge is aligned with the extreme edge of enlargement 42 while the other edge is aligned with the center of aperture 28. As is best seen in FIG. 4, once the connector contact 30 has been positioned within the aperture 28 and the keeper member 44 placed atop the base member 22 the contact 30 is no longer permitted to move upwardly, that is, in the direction of the first surface 24 of the base member 22. The contact 30 is thus effectively trapped within this position and cannot be removed from the base member 22. It should also be noted that circular aperture 46 matches the configuration of the upper portion of the contact 30 and therefore provides additional support to prevent the individual arms 32 and 34 from being deflected out of position during assembly of the contact 30 to a flat cable and thereby interfering with, or preventing, the operation of the connector 20, as desired.

Figure 6:
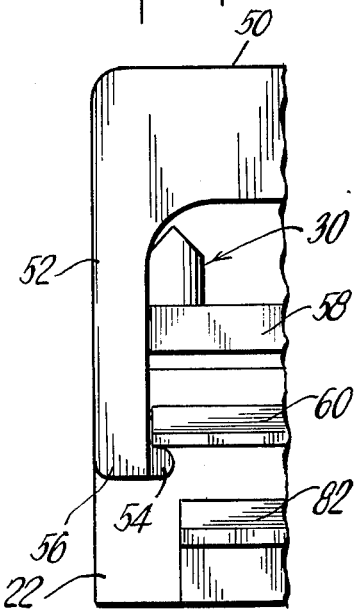
FIG. 6 is a fragmentary side elevational view showing the selectively operable latch mechanism of the connector of FIG. 1 in a first operating position.
Figure 7:
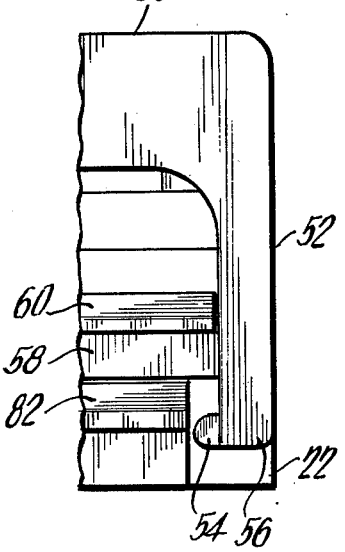
FIG. 7 is a fragmentary side elevational view of the selectively operable latch mechanism of the connector of FIG. 1 operated to the second position.

Placed atop the connector assembly, as is shown in FIG. 4, prior to the insertion of a flat cable into the connector 20 is a cover member 50 having selectively operable latch means 52 at each end thereof. These selectively operable latch means are fully described and claimed by my Co-pending Application No. 2 listed above. To summarize the construction and operation thereof, selectively positionable latch means 52, has first locking tabs 54 at the ends of two latch receiver arms 56 and a latching bar 58 extending between latch receiver arms 56 intermediate their ends. On each end of the base member 22 is a latch bar 60. As is seen in FIGS. 6 and 7, the operation of the selectively positioned latch member may be better appreciated. In a first position, that is, with the cover member 50 spaced apart from the upper surface of the contacts 30 such that a flat cable may be passed therethrough without difficulty or conversely that the entire assembly of the connector 20 may be moved along a flat cable without interference therewith, the selectively positionable latch means is set to its first position wherein the locking tabs 54 extend below latch bar 60. In order to operate the connector 20 to pierce the insulation of the flat cable and make a joint with the contacts 30 therein, the cover means 50 is pushed to the second position, as is shown in FIG. 7. In this position, the latch receiver arms 56 are moved downwardly such that the latch bar 60 is now positioned above latching bar 58. In such a position the cover member 50 is locked into engagement with the flat cable placed therein and the individual conductors have been forced into contact with their associated contacts 30 to make a good electrical and mechanical connection therewith.

Figure 8:
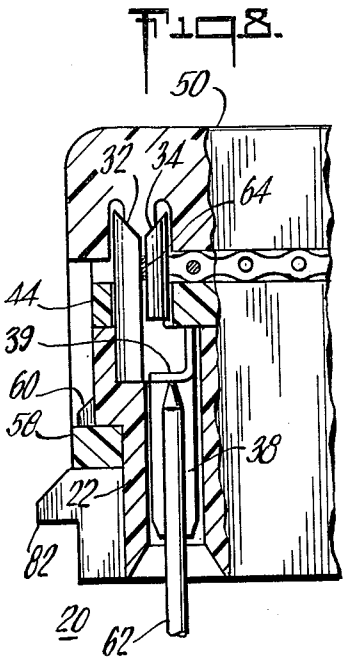
FIG. 8 is a fragmentary front elevational view, partially in section, of a partial assembly of the connector of FIG. 1 to a flat cable and further to a contact pin of a further connector.

As is best seen in FIG. 8, a fragmentary front elevational view of the connector 20 of FIG. 1 is used to join together individual conductors 64 of a flat cable 66 to terminal pins 62 of a further connector (not shown) each pin 62 placed within an aperture 28 of the base member 22. Contact 30, as has been described above, is placed in aperture 28 and has placed thereover the keeper means 44 which causes the contact 30 to be retained within the base member 22 and which supports and aligns the upper arms 32 and 34 of the contact 30 in proper position to pierce through the insulation of the flat cable 66 to make good electrical contact with the individual conductors 64. The cover means 50 is shown in place with the latching bar 58 positioned below the latch bar 60, as was described above with respect to FIG. 7. The entire connector 20 may then be positioned upon the pins, such as pin 62 of a further connector, or, individual pins or connectors may be plugged into the connector 20.

Figure 10:
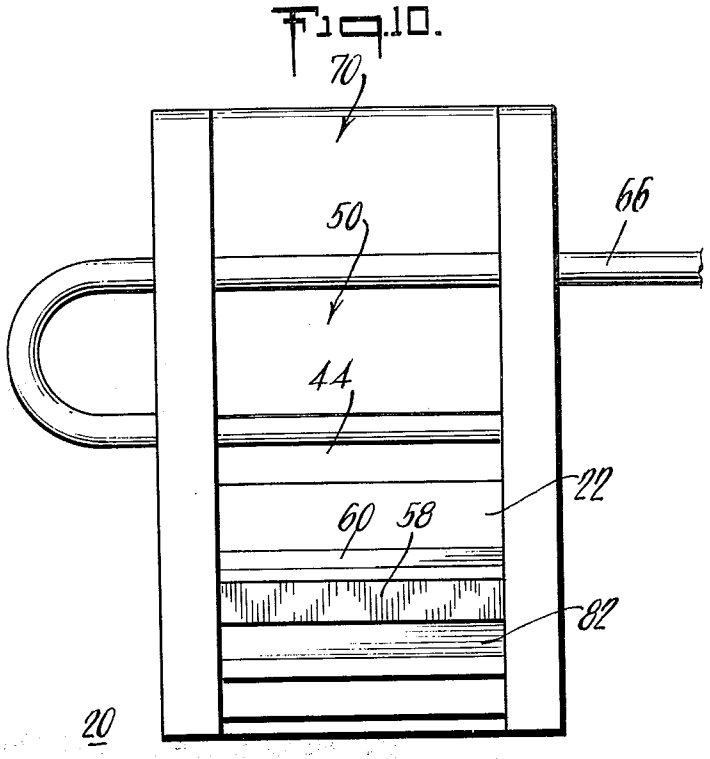
FIG. 10 is a side elevational view of the connector of FIG. 1 fully assembled to a flat cable.
Figure 9:
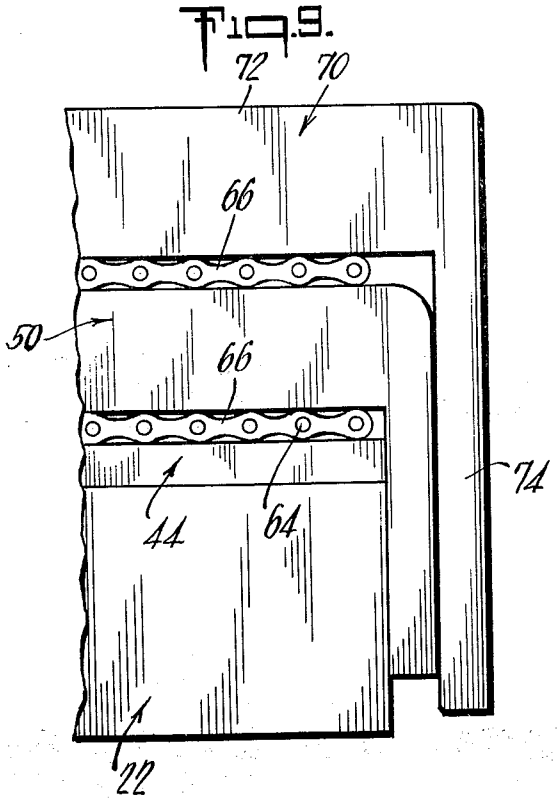
FIG. 9 is a fragmentary front elevational view of the connector of FIG. 1 fully assembled to a flat cable.

In such a connection it is possible for forces to be placed on the flat cable 66 in such a manner as to interfere with, or loosen, the connection and perhaps even separate the connection between the individual conductors 64 and the contacts 30. To prevent this, a strain relief, as is shown in FIGS. 1, 9, and 10 is employed. FIG. 10 illustrates the manner in which the flat conductor cable 66, after having been terminated to individual contacts 30 and appearing between the cover 50 and the keeper means 44 of the connector 20 is then returned over top the cover 50 and thence to the utilization device. Placed over top the flat conductor cable 66 is the strain relief 70, as is best seen in FIG. 1, which is constructed of a transverse member 72 which extends over the central portion of the cover member 50 and terminates in two end sections 74. Each of the end sections 74 consists of a pair of legs 76 held together in parallel relationship by a bar 78. The legs 76 are undercut, or notched, as at 80 in order that the bar 78 be recessed and thereby spaced apart from the latch bar 60 when the legs 76 are placed over the base member 22. Base member 22 includes a further latch finger 82 more narrow than the width of the latch bar 60 but longer in a direction transverse to the side walls of the base member 22. In this manner, the bar 78 can be placed over the entire assembly of the connector 20 and a cable 66 and will not interfere with the functioning of the cover member 50 but yet be able to make proper locking engagement with the latch finger 82 when positioned thereover. In the final assembled version of the connector 20, as shown in FIG. 9, full engagement is made with the individual conductors 64 of the flat cable 66 as it passes between the cover member 50 and the keeper means 44. The cable is then, as is shown in FIG. 10, returned over top of the cover means 50 between the cover means 50 and the bottom surface of the member 72 of the strain relief 70. Any stress placed upon the flat cable at positions remote from the connector 20 are received and absorbed by the strain relief 70 and not passed on to the junctions between the individual conductors 64 and the electrical contacts 30 which might otherwise interfere with their proper operation.

While there have been shown and described and pointed out the fundamental novel features of the invention as applied to the preferred embodiments it will be understood that various omissions, substitutions, and changes of the form and detail of the device illustrated and in its operation may be made by those skilled in the art, without departing from the spirit of the invention.

The embodiments of the invention in which an exclusive property or privege is claimed are defined as follows:

1. A connector for connecting each of the conductors of a multi-conductor flat cable to a termination point comprising: a base member having a first surface and a second surface and a plurality of apertures therein extending from said first surface to said second surface, the number of said apertures being equal to the maximum number of conductors which can be present in said multi-conductor flat cable; a plurality of elongate contacts, one for each of said apertures, said contacts having a circular, dual slotted conductor contact portion, said two slots dividing said contact into two radial arms, at one end of said contact, a post contact portion at its other end and a tab, having a first edge and a second edge, intermediate the two ends of said contact, said contacts being inserted in said apertures to position said conductor contact portion adjacent said first surface of said base member with the first edge of said tab aligned with said first surface of said base member and said post contact portion adjacent said second surface of said base member; keeper means having a plurality of additional apertures equal in number to the number of apertures in said base member and of a size which permits said arms to freely deflect in a first direction radially outwardly from the longitudinal axis of said contact as a conductor of such multi-conductor flat cable is forced into said two slots of said conductor contact portions; said keeper means having a predetermined thickness less than the height of said conductor contact portions to permit said arms to freely deflect in a second direction obliquely away from the longitudinal axis of said contact, said keeper means being permanently coupled to said base member in such manner as to align said additional apertures with said apertures in said base member; cover means having an inner surface and an outer surface, and a plurality of recesses in said cover means extending from said inner surface towards said outer surface and terminating intermediate said inner and outer surface, one recess for each of said contacts and aligned with said additional apertures of said keeper means, each recess arranged to receive the free ends of said arms of its associated contact after said arms have pierced the insulation and extended through the thickness of such multi-conductor flat cable; and latch means for selectively coupling said base member to said cover means; the application of a force to said outer surface of said cover means, when a multi-conductor flat cable is inserted between said inner surface of said cover means and the free ends of said arms of said contacts, causing each conductor of said multiconductor flat cable to enter its associated one of said contacts and the free ends of said arms to enter its associated recesses in said cover means as said latch means operates to hold said inner surface of said cover means and the exposed surface of said keeper means in intimate contact with said multi-conductor flat cable.

2. A connector as defined in claim 1, wherein said apertures in said base member are rectangular and said additional apertures in said keeper means are round.

3. A connector as defined in claim 1, wherein said aperture in said base member is rectangular and is enlarged adjacent said first surface of said base member to provide a shelf between said first surface of said base member and said second surface thereof to prevent said contacts from being removed from said base member in the direction of said second surface of said base member; and said additional apertures in said keeper means being round, said keeper means being coupled to said base member adjacent said first surface to prevent said contact means from being removed from said base member in the direction of said first surface.

4. A connector as defined in claim 1, wherein said keeper means is coupled to said base member adjacent said first surface thereof.

5. A connector as defined in claim 1, wherein said keeper means is welded to said base member first surface.

6. A connector as defined in claim 1, wherein said keeper means is adhered to said base member first surface by adhesive means.

7. A connector as defined in claim 1, further comprising strain relief means overlying said cover means and a portion of said multi-conductor flat cable passed thereover and engaging said flat cable and further latch means for coupling said strain relief means to said base member.

* * * * *